United States Patent [19]

Bartzick et al.

[11] Patent Number: 4,605,178

[45] Date of Patent: Aug. 12, 1986

[54] DEVICE FOR THE COMPENSATING STORAGE OF PACKING BAND IN PACKAGING MACHINES

[75] Inventors: Günter Bartzick, Ennepetal; Gerd Bühne, Schwelm; Reinhard Naydowski, Ennepetal, all of Fed. Rep. of Germany

[73] Assignee: Hoesch Aktiengesellschaft, Dortmund, Fed. Rep. of Germany

[21] Appl. No.: 657,679

[22] Filed: Oct. 4, 1984

[30] Foreign Application Priority Data

Oct. 4, 1983 [DE] Fed. Rep. of Germany ..... 3335964

[51] Int. Cl.[4] ..... B65B 13/02; B65H 20/24; B65H 20/26

[52] U.S. Cl. ..... 242/55; 53/589; 100/26; 242/55.21

[58] Field of Search ..... 242/55, 55.17, 55.21; 53/589, 582, 118, 430; 100/26

[56] References Cited

U.S. PATENT DOCUMENTS

| | | | |
|---|---|---|---|
| 2,085,439 | 6/1937 | Morlock | 242/55 X |
| 2,113,845 | 4/1938 | Kleerup | 242/55 X |
| 3,447,447 | 6/1969 | Rutty | 100/26 |
| 3,860,188 | 1/1975 | Bradshaw | 242/55.21 |
| 3,999,718 | 12/1976 | Ziemba | 242/55 |
| 4,012,004 | 3/1977 | Tonellato | 242/55 X |
| 4,505,438 | 3/1985 | Sendzimir et al. | 242/55 |

FOREIGN PATENT DOCUMENTS 2262148 12/1972 Fed. Rep. of Germany .

*Primary Examiner*—Stuart S. Levy
*Assistant Examiner*—Lynn M. Sohacki
*Attorney, Agent, or Firm*—Eric P. Schellin

[57] ABSTRACT

The packaging band in packaging machines, especially when it is formed from plastic, was previously temporarily stored in meandering loops. According to the invention, the band is stored in coils in a spiral relationship to each other, whereby the center of the spiral is shifted and the coils have a free intermediary space between each other. The packaging band can be easily fed at a tangent to the start of the smallest coil without sharp bends and removed at the largest coil by means of shifting the center. The spiral can also be in a standing position. It is advantageous in this instance if the packaging band is fed in and removed in the vicinity of the lowest point. The innermost coil is not limited in its size by any fixed stop means, but rather the infeed of packaging band is cut in by a sensing switch when the radius of the inner coil has reached a certain minimum size. The switch also cuts out the infeed to the storage unit in time during operation, so that the outermost coil does not firmly contact an outer ring.

4 Claims, 4 Drawing Figures

DEVICE FOR THE COMPENSATING STORAGE OF PACKING BAND IN PACKAGING MACHINES

BACKGROUND OF THE INVENTION

1. Field of the Invention:

The invention is related to a method of and a device for compensating for the different speeds during the unwinding and supplying of a packaging band. The band is unwound relatively slowly from a supply roll at long time intervals, and is supplied to a packaging machine after it has passed through a compensating storage unit at rather brief intervals at a greater speed.

2. Description of the Prior Art:

DE No. 22 62 148 teaches a method and a device for storing steel band in a roll. Long lengths of band are stored in a plurality of coils. If the roll functions as compensation, due to varying in and outfeed speeds of the band, the heavy roll must be rotated. Driven rollers are used in this operation as auxiliary drives. The method and device described in DE No. 22 62 148 are unsuitable if the band must be drawn off very rapidly for brief periods from the roll. Great inertia forces arise when the support table is put jerkily into rotation.

Such a jerky consumption of band occurs in the rapid-running packaging machines in use at the present. According to the principle of DE No. 22 62 148, in the case of a jerky consumption the inner band coils would lie very tightly on the limiting inner stop and on each other. This would have the result that the band fed to the roll with the smallest inner radius could not longer tightly press the inner coils. The infeed band would hesitate in the infeed channel, form undulations in that area and jam. The danger of jamming is very great particularly in the case of thin, relatively readily flexible packaging bands made of plastic. For this reason plastic packaging bands are stored in free loops which lie in a meandering fashion on each other and can not clamp tightly onto each other. This has the disadvantage that the band is curved in a very tight radius at the bending-back points of the loops. If the packaging machine is not used for half an hour, the sharp bends are taken up in the packaging band. This piece of packaging band must then be cut off and discarded, and the storage unit of the packaging machine must be refilled with new meandering loops for further usage.

SUMMARY

The invention has the task of eliminating the disadvantages of the described methods of storage and of creating a storage unit which stores packaging band without sharp bends and in which the packaging band can be removed rapidly and intermittently from the storage unit.

This task is solved as follows: The packaging band is stored during normal operation, except for an initial state, in a roll whose roughly circular coils are loosely wound around each other with intermediary spaces, whereby the infeed on the innermost coil and the outfeed of packaging band on the outermost coil are halted at the latest if a calculated average value of the distance to the adjacent coil, measured at 3 measuring points on a coil staggered by 120°, is less than the thickness of the packaging band.

If the packaging machine is drawing off the band intermittently, only the few coils of the roll rotate which have a smaller diameter after being drawn off than they did previously. Packaging band for only one to five hoopings is stored in the roll. While the drawing off of the band from the storage unit occurs intermittently for only a very brief period, the infeed takes place considerably slower and over a longer period of time. This has the known advantage that the heavy supply roll need rotate only slowly, which is important as regards accidents.

In order that the packaging band runs into the roll without hesitation and distortion, it is advantageous if the band is supplied on the innermost coil of the roll in a range which lies on a circular ring whose center coincides with the center of an outer ring and whose greatest and smallest radius is between 95% and 70% of the radius of a limiting outer ring has, or which the greatest possible outer coil has if there is no outer ring. For the same reason, it is advantageous if the packaging band is supplied through a conduit or some other guide means right up to the inner coil and is guided without guide means approximately tangentially into the innermost coil.

It is advantageous if, in the range of a sensing switch, the coils are widely spaced from each other, as easily recognizable switching differences for the switch will then result. Great spacings of the coils are achieved as follows: The roll is formed standing upright and the coils lie eccentrically and the closest to each other above the lowest point of the roll and the furthest from each other below the uppermost point.

This eccentric arrangement of the coils also has the advantage that the band supplied to the storage unit does not have to be sharply curved. A relatively great curvature radius in the band is produced if it is supplied to the upright roll somewhat above the lowest point of the roll approximately parallel to the tangent to the lowest point of the roll. As a result of the contacting of the roller at the lowest point due to the weight, the roll has a certain stability there and, in addition, that is the only point where friction occurs. It is advantageous if the band is likewise drawn off at this point, since the forces arising from the friction can not be propagated then in a disturbing manner to the inner coils of the roll.

A device for carrying out the method comprises a storage unit which is interposed between the supply roll and the packaging machine, which has a narrow, annularly limited storage area which is slightly wider than the roll of packaging band to be stored in it. A guide supply track directs the band to the storage unit and empties over the range of a circular ring approximately tangentially to the innermost coil forming during operation. The greatest and the smallest radius of this circular ring is between 95% and 70% of the radius of the limiting outer ring has or, if there is no outer ring, which is the radius of the greatest possible coil of the roll. The center of this circular ring coincides with the center of the outer ring or of the outermost coil. At least one switch provided with a sensor for the coils of the roll is connected to the drive of a transport device (pair of rollers) which supplies the band to the storage unit. The sensor is set so that the switch is set to cut in the drive when a preselected diameter of the innermost coil has been reached, and the switch is in the cut-out position when a greater preselected diameter has been reached. The on and off points of the switch are selected in such a manner for normal operation, with the exception of the first filling procedure. Although, the diameter of the coils is constantly changing during operation, a free intermediary space to the adjacent coil remains at least part of each coil. The smallest innermost coil is kept open by its own elastic power and its remaining inner space is constructed so as to be free from the smallest stops which determine the diameter.

The coils of the storage unit can be used very rapidly for storing or supplying the packaging band because only the slight masses of the coils themselves have to be accelerated and, in addition, almost no frictional forces occur. To this end the elastic force of the packaging band, the number of coils and the radius of the coils are set in such a manner in relation to each other that the coils do not contact each other over the greatest part of their circumference and a free intermediary space remains. A largely self-supporting coil is obtained, in particular, if the coils of the roll lie in a vertical plane and are closer to each other in the vicinity of the lowest point of the roll than in the vicinity of the uppermost point.

In order that the band can be guided after it leaves the storage area without great friction through a linear guide track to the hooping machine, it must not be curved too sharply before hand. Curves in the tag band that are too sharp can not be taken out any longer on account of the permanent deformations. They are avoided as follows: The infeed of the band to the intermediary storage unit somewhat above the lowest point of the roll takes place by means of a straight or curved guide track and the mouth of the guide track runs approximately parallel to a tangent to the lowest point of the roll. In addition, the infeed is curved corresponding to a 180° rotation of a helix and the radium of the helix is approximately equal in its magnitude to the smallest radius of the coil determined by the cut-in position of the switch.

BRIEF DESCRIPTION OF THE DRAWINGS

FIG. 1 shows the entire packaging machine with storage unit.

FIG. 2 shows the storage unit.

FIG. 3 shows the opened outer ring of the storage unit.

FIG. 4 shows a switch with sensor.

DETAILED DESCRIPTION

Figure 1:
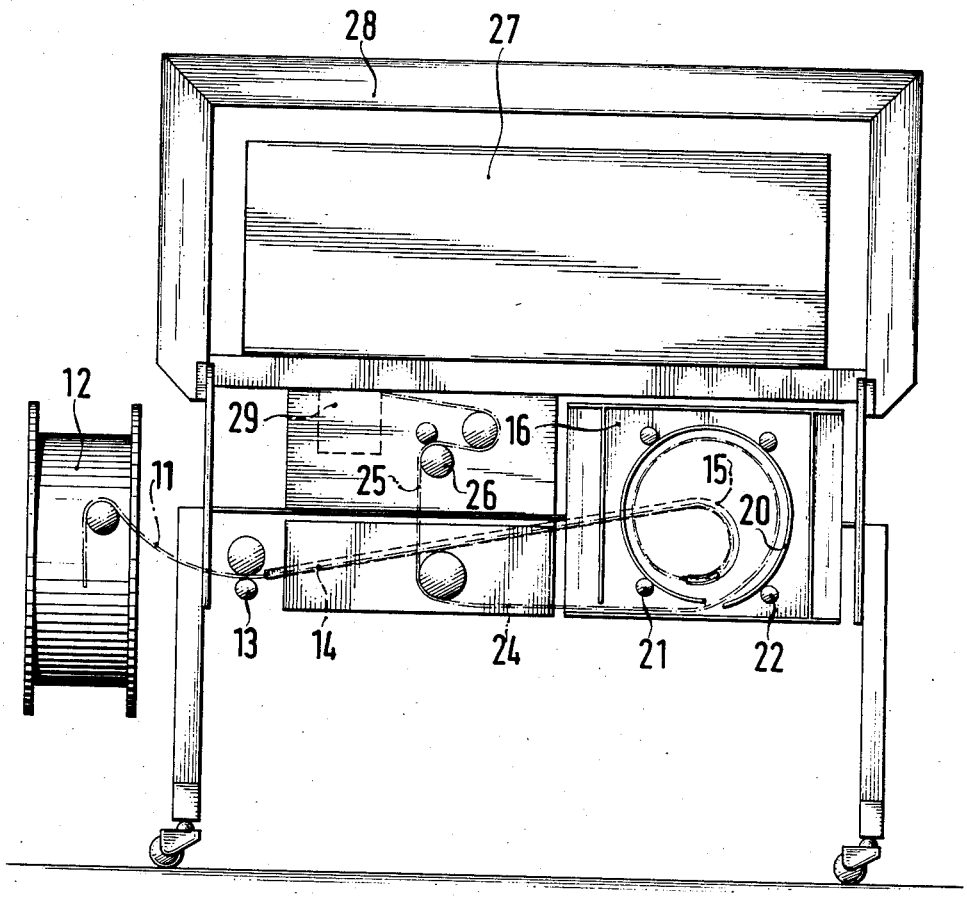
FIGS. 1 to 4 show an embodiment of the invention.
Figure 2:
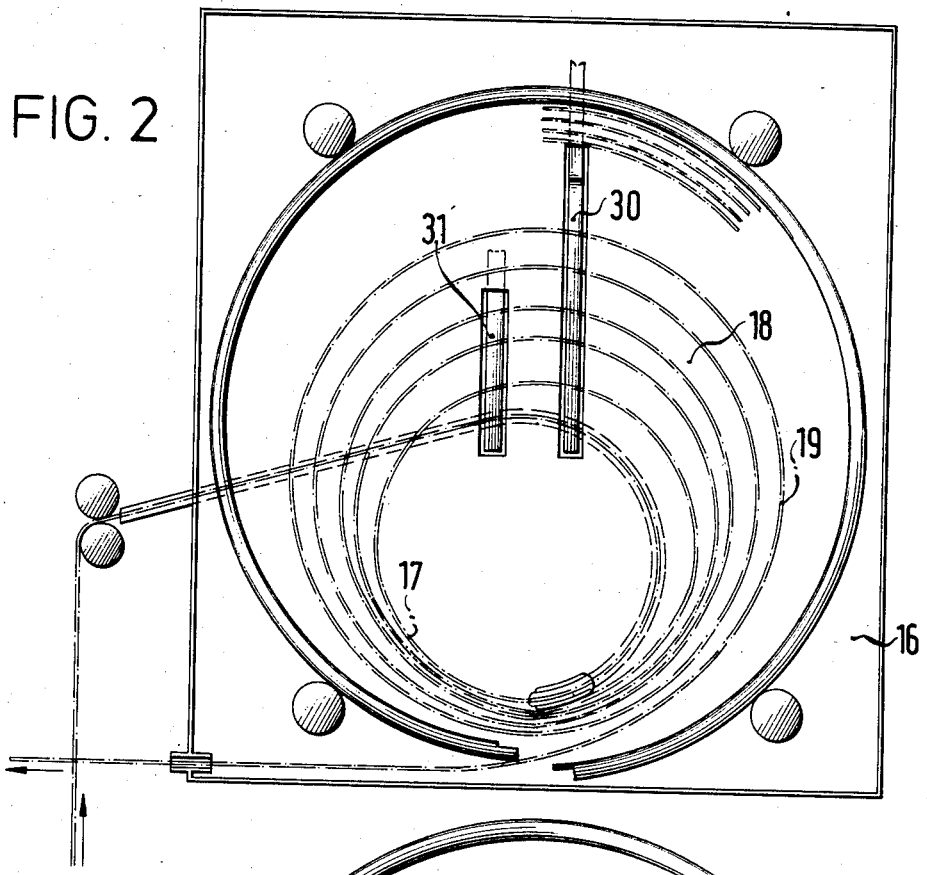
Figure 3:
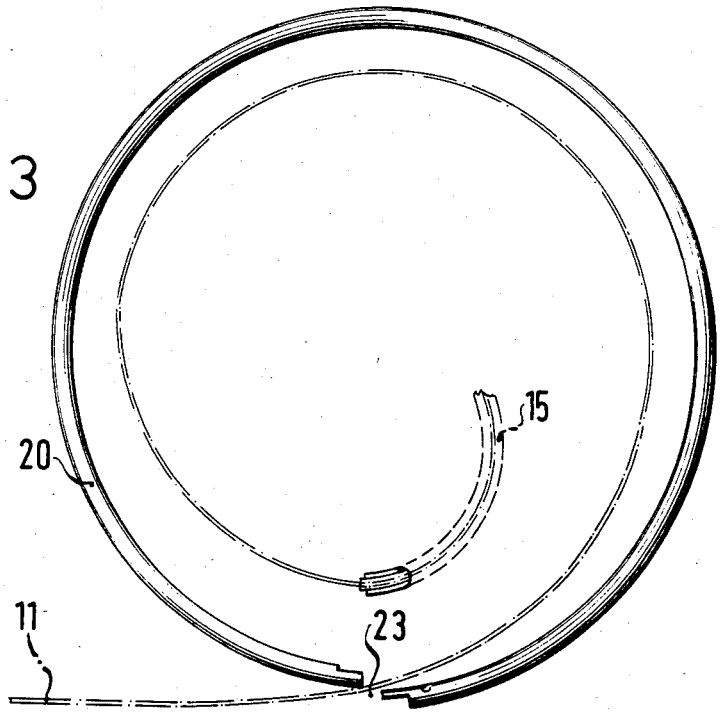

Packaging band 11 is normally drawn off large supply roll 12 with the aid of motor-driven roller pair 13. In back of roller pair 13 packaging band 11 is thrust through straight guide conduit 14 and curved guide track 15 into storage unit 16. On account of the thrusting movement in guide conduit 14 and guide track 15, only very slight frictional forces may occur in them. If the frictional forces were rather strong, band 11 itself would form undulations in straight conduit 14 and jam. The large radius of guide track 15 assures a low friction.

In storage unit 16 band 11 is transported from the innermost coil 17 in a spiral with a shifted center to the outmost coil 19 of the roll coil. Outermost coil 19 contacts outer ring 20 only during the first filling procedure. Outer ring 20 is annularly closed during the first filling of storage unit 16 and rotatably mounted on rollers or bearings 21 and 22. Outer ring 20 rotates once for each stored coil. When, during the first filling, a sufficient number of coils is present in storage unit 16, outer ring 20 is opened at its lowest position of point 23, whereby the ends are bent apart in a slightly elastic manner and stopped or hooked in the open position. The start of packaging band 11 is guided through the opening created at point 23 by the operator onto path 24 and 25 to driven roller pair 26. One roller pair 26 has caught the start of band 11, the rest of band 11 is drawn off automatically from storage unit 16 as needed. Roller pair 26 guides the band in a known manner through hooping conduit 28 around package 27 to be hooped until the start reaches closure head 29.

The drive of roller pair 26 is regulated by the closure head. Roller pair 26 draws the band 11 required for one hooping very rapidly form storage unit 16. Then a pause occurs until the next hooping. In contrast thereto, drive 13 draws the band from supply roll 12 at a considerably lesser speed. This speed, which is lesser than that of roller pair 26, is compensated by a longer runner time of drive 13. It is advantageous if drive 13 only runs slowly, because it must put the large mass of supply roller 12 into motion. With the exception of the first filling, an intermediary air space is left between outer ring 20 and outermost coil 19 of roll 18 during refilling during normal operation, so that no friction can occur between these parts. It is important that band 11 is drawn from storage unit 16 with a relatively low force, as rollers 26 press against the band with only a slight force. This setting with a low pressure force of rollers 26 is selected so that rollers 26 can slide along band 11 when the front edge of band 11 reaches a stop in the closure head and band 11 is suddenly braked. Rollers 26 and their drive can not be braked so suddenly, but continue to make a few revolutions until they come to a stop.

Drive 13 for the band advance is regulated by switch 30. Switch 30 contains sensor 32 which is constructed as a lever and is pressed with a slight elastic force laterally against the front surfaces of the coils.

Figure 4:
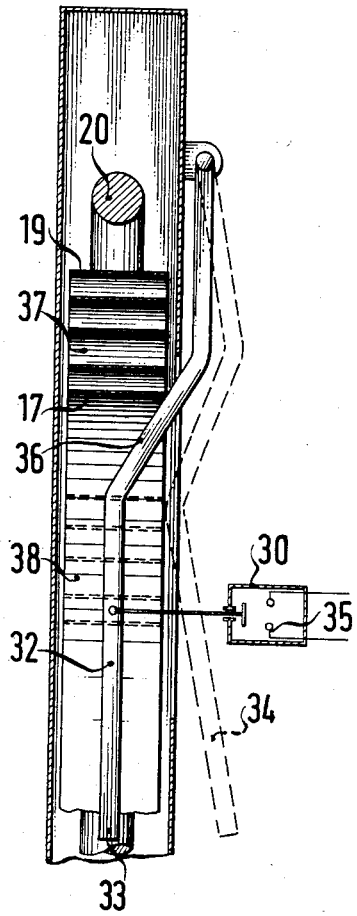

FIG. 4 shows roll 18 in cut-in position 38 and cut-out position 37. In cut-in position 38 roller 18 presses sensor 32 into position 34, shown in dotted lines, whereby cut-in contact 35 for the drive of rollers 13 is closed. As soon as band 11 is transported by guide track 15 into storage unit 16, the diameter of the coils of roll 18 becomes greater and the latter reaches cut-out position 37. Sensor 32 is provided with sloping section 36 in order to achieve a smooth transition from the two extreme positions 34 and 33. Cut-in contact 35 is already closed when innermost coil 17 contacts the first third of sloping section 36. Normally, the diameter of the coils decreases further in spite of the cut-in drive of rollers 12, because the drawing-off of band 11 by rollers 26 occurs more rapidly. Roll 18 can therefore reach position 38. In a pause, when, for example, a new package is introduced into the hooping machine, only the drive of rollers 13 runs, so that cut-out position 37 of roll 18 is reached before the next hooping.

It is also possible to use other types of switches instead of switch 30 with sensor 32. Thus, for example, sensor 32 can be replaced by a beam of light which runs in accordance with slope 36. When this beam of light is interrupted, a photoelectric cell and a connected relay cut in the drive for rollers 13.

A second monitoring switch 31 is necessary for operating the device which performs a cut-out operation when the front end of band 11 misses a stop which cuts out the drive of rollers 26. In such an instance rollers 26 would draw band 11 form storage unit 16 until the diameter of roll 18 had become quite small and all coils would lie tightly on each other and practically be jammed, so that storage unit 16 could no longer be refilled. In order to prevent such an operational malfunction, switch 31, which constructed like switch 30, monitors with its sensor a circular area inside roll 18 whose diameter is even smaller than the diameter of the smallest coil which normally occurs during operation. This switch 31 cuts out the drive to rollers 26 or to the entire automatic packaging apparatus when its scanner is pressed up by a coil.

Instead of using limiting ring 20, the start of band 11 can also be bent into a ring by hand, in which case the start is held fast by adhesive tape, for example. Such a limiting ring is advantageously limited in diameter by a least three light, rotatably rollers or bearings staggered by 120°. These rollers or bearings assure the ability to rotate during the first filling.

The described device for plastic packaging band can also be employed with advantage for steel packaging band. The roll axis can also be in a position other than horizontal, e.g. vertical.

We claim:

1. A device for compensating for different speeds of a moving packaging band during unwinding and supplying of the packaging band to a packaging machine, the packaging band is unwound relatively slowly from a supply roll for long intervals and is supplied to a packaging machine after it has passed through a compensating storage unit interposed between the supply roll and the packaging machine, the device is characterized in that the compensating storage unit comprises:

a storage area adapted and constructed to accept and temporarily store a portion of a packaging band in a loosely coiled coil roll, the storage area being slightly wider that the width of a coil roll of a packaging band;

a circular ring positioned within the storage area defining a circle having a radius, a coil roll of a packaging band is positioned inside the circular ring, a coil roll of a packaging band having an outermost coil the radius of which is limited by the radius of the circular ring;

a guide supply track adapted and constructed for directing a packaging band from a supply roll to form a coil roll of a packaging band in the circular ring, a coil roll of a packaging band having an innermost coil to which a packaging band of the supply roll is directed;

a sensor for sensing the diameter of a innermost coil of a coil roll of a packaging band in the circular ring, the sensor comprises a lever which is pressed against a coil roll, the lever is provided with outwardly extending substantially parallel arms connected at inner ends with a generally centrally located sloping section that contacts the coils and as the radius of the smallest coil becomes smaller it presses the lever away from the coils; and a switch for stopping a moving packaging band through the compensating storage unit when a preselected diameter of an innermost coil of a coil roll of a packaging band in the circular ring is reached, as determined by the movement of the lever away from the coils.

2. Device according to claim 1, characterized in that the circular ring (20) is interrupted for the removal of an outermost coil (19) of a packaging band (11).

3. Device according to claim 2, characterized in that the one end of the circular ring (20) can be elastically bent out of an original annular track to form the interruption.

4. Device according to claim 3, characterized in that the circular ring (20) is rotatably mounted.

* * * * *